US009704702B2

(12) United States Patent
Yamashita

(10) Patent No.: US 9,704,702 B2
(45) Date of Patent: Jul. 11, 2017

(54) FLASH LIGHT SOURCE DEVICE

(71) Applicant: HAMAMATSU PHOTONICS K.K., Hamamatsu-shi, Shizuoka (JP)

(72) Inventor: Yuichi Yamashita, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 14/774,143

(22) PCT Filed: Feb. 10, 2014

(86) PCT No.: PCT/JP2014/053051
§ 371 (c)(1),
(2) Date: Sep. 10, 2015

(87) PCT Pub. No.: WO2014/141793
PCT Pub. Date: Sep. 18, 2014

(65) Prior Publication Data

US 2016/0042938 A1 Feb. 11, 2016

(30) Foreign Application Priority Data

Mar. 14, 2013 (JP) ..... 2013-051708

(51) Int. Cl.
*H01J 61/56* (2006.01)
*H01J 61/80* (2006.01)
*H05B 41/32* (2006.01)

(52) U.S. Cl.
CPC ..... *H01J 61/56* (2013.01); *H01J 61/80* (2013.01); *H05B 41/32* (2013.01)

(58) Field of Classification Search
CPC ..... H01J 61/56; H01J 61/80; H05B 41/32
(Continued)

(56) References Cited

U.S. PATENT DOCUMENTS 8,304,973 B2 11/2012 Yamashita et al.
2006/0119282 A1* 6/2006 Hackenbuchner ..... H01J 61/34 315/209 R (Continued)

FOREIGN PATENT DOCUMENTS

CN 201083936 7/2008
CN 101630591 1/2010

(Continued)

OTHER PUBLICATIONS

Translation of JP 2004342326; Kido, Shojiro; Dec. 2004.*

*Primary Examiner* — Alexander H Taningco
*Assistant Examiner* — Renan Luque
(74) *Attorney, Agent, or Firm* — Drinker Biddle & Reath LLP

(57) ABSTRACT

A flash light source device includes a flash lamp, a wring board, and a power feeding unit. The flash lamp includes a sealed container provided with a light transmission window on one end face and having a discharge gas enclosed therein, a cathode and an anode to induce arc discharge in the sealed container, and lead pins projecting from the other end face of the sealed container. The wiring board has a principal surface and a back surface. The lead pins of the flash lamp arranged opposite to the principal surface are bonded so as to be fixed in an electrically conductive manner to the wiring board. The power feeding unit implements charge and discharge of an electric current to be supplied to the flash lamp. The power feeding unit has chip capacitors surface-mounted on the wiring board.

25 Claims, 5 Drawing Sheets

(58) Field of Classification Search
USPC ..... 362/34, 228, 229, 261, 263, 157; 313/110, 272, 316, 514, 581; 315/71, 53
See application file for complete search history.

(56) References Cited

U.S. PATENT DOCUMENTS

| | | | | |
|---|---|---|---|---|
| 2007/0181897 | A1 | 8/2007 | Liaw | |
| 2007/0236920 | A1* | 10/2007 | Snyder | F21L 4/027 362/157 |
| 2008/0100413 | A1* | 5/2008 | Baechtiger | H01C 10/12 338/114 |
| 2011/0234096 | A1* | 9/2011 | Asmussen | H05B 41/042 315/53 |
| 2012/0043883 | A1* | 2/2012 | Yamashita | H01J 61/90 313/581 |

FOREIGN PATENT DOCUMENTS

| | | | | |
|---|---|---|---|---|
| EP | 1178711 | | | 2/2002 |
| JP | S55-160061 | | | 5/1980 |
| JP | S60-116111 | | | 6/1985 |
| JP | H07-181568 | A | | 7/1995 |
| JP | H09-27213 | A | | 1/1997 |
| JP | H10-229027 | | | 8/1998 |
| JP | 2000-076921 | A | | 3/2000 |
| JP | 2000-268991 | A | | 9/2000 |
| JP | 2001-060826 | | | 3/2001 |
| JP | 2001-216939 | | | 8/2001 |
| JP | 2001-332217 | | | 11/2001 |
| JP | 2004-171820 | A | | 6/2004 |
| JP | 2004342326 | A | * | 12/2004 |
| JP | 2008-047363 | A | | 2/2008 |
| JP | 4170461 | | | 10/2008 |
| JP | 2012-179339 | A | | 9/2012 |

* cited by examiner

FLASH LIGHT SOURCE DEVICE

TECHNICAL FIELD

The present invention relates to a flash light source device.

BACKGROUND ART

Patent Document 1 describes the technology about a lamp light source having a xenon flash lamp. This xenon flash lamp has a structure in which a plurality of lead pins project from one end side in a tube-axis direction, and is mounted on a board having a board surface perpendicular to the tube-axis direction. Furthermore, a trigger circuit including capacitors is mounted on a back surface of this board.

CITATION LIST

Patent Literature

Patent Document 1: Japanese Patent Application Laid-Open No. 2000-76921

Patent Document 2: Japanese Patent Application Laid-Open No. 2012-179339

Patent Document 3: Japanese Patent Application Laid-Open No. 2004-171820

Patent Document 4: Japanese Patent Application Laid-Open No. H7-181568

SUMMARY OF INVENTION

Technical Problem

There is a conventionally-provided flash light source device having a flash lamp for inducing arc discharge in a sealed container in which discharge gas such as xenon is enclosed, and a circuit for making the flash lamp emit light. In the flash light source device of this type, a capacitor is disposed in the circuit for making the flash lamp emit light, in order to instantaneously supply a large electric current to the flash lamp. A film capacitor is generally used as this capacitor, and the film capacitor has a large size, which contributes to a hindrance to size reduction of the flash light source device.

The present invention has been made in view of the above problem, and an object thereof is to provide a flash light source device that can be constructed in a smaller size.

Solution to Problem

In order to solve the above-described problem, a flash light source device according to the present invention comprises: a flash lamp including a sealed container having a substantially tubular shape with a central axis direction along a predetermined direction and having a discharge gas enclosed therein, a cathode and an anode arranged in juxtaposition in the sealed container to induce arc discharge, and first and second lead pins projecting from one end face of the sealed container in the predetermined direction and electrically connected to the cathode and to the anode, respectively; a wiring board having a principal surface and a back surface intersecting with the predetermined direction, and to which the first and second lead pins of the flash lamp arranged opposite to the principal surface are fixed in an electrically conductive manner; and a power feeding unit for charge and discharge of an electric current to be supplied to the flash lamp, wherein the power feeding unit includes one or a plurality of chip capacitors surface-mounted on the wiring board.

In this flash light source device, the power feeding unit has one chip capacitor or the plurality of chip capacitors surface-mounted on the wiring board. The chip capacitors have an extremely smaller size than the film capacitors. Therefore, it becomes feasible to achieve size reduction of the flash light source device.

Advantageous Effects of Invention

The present invention has provided the flash light source device that can be constructed in a smaller size.

DESCRIPTION OF EMBODIMENTS

An embodiment of the flash light source device according to the present invention will be described below in detail with reference to the accompanying drawings. The same elements will be denoted by the same reference signs in the description of the drawings, without redundant description.

Figure 1:
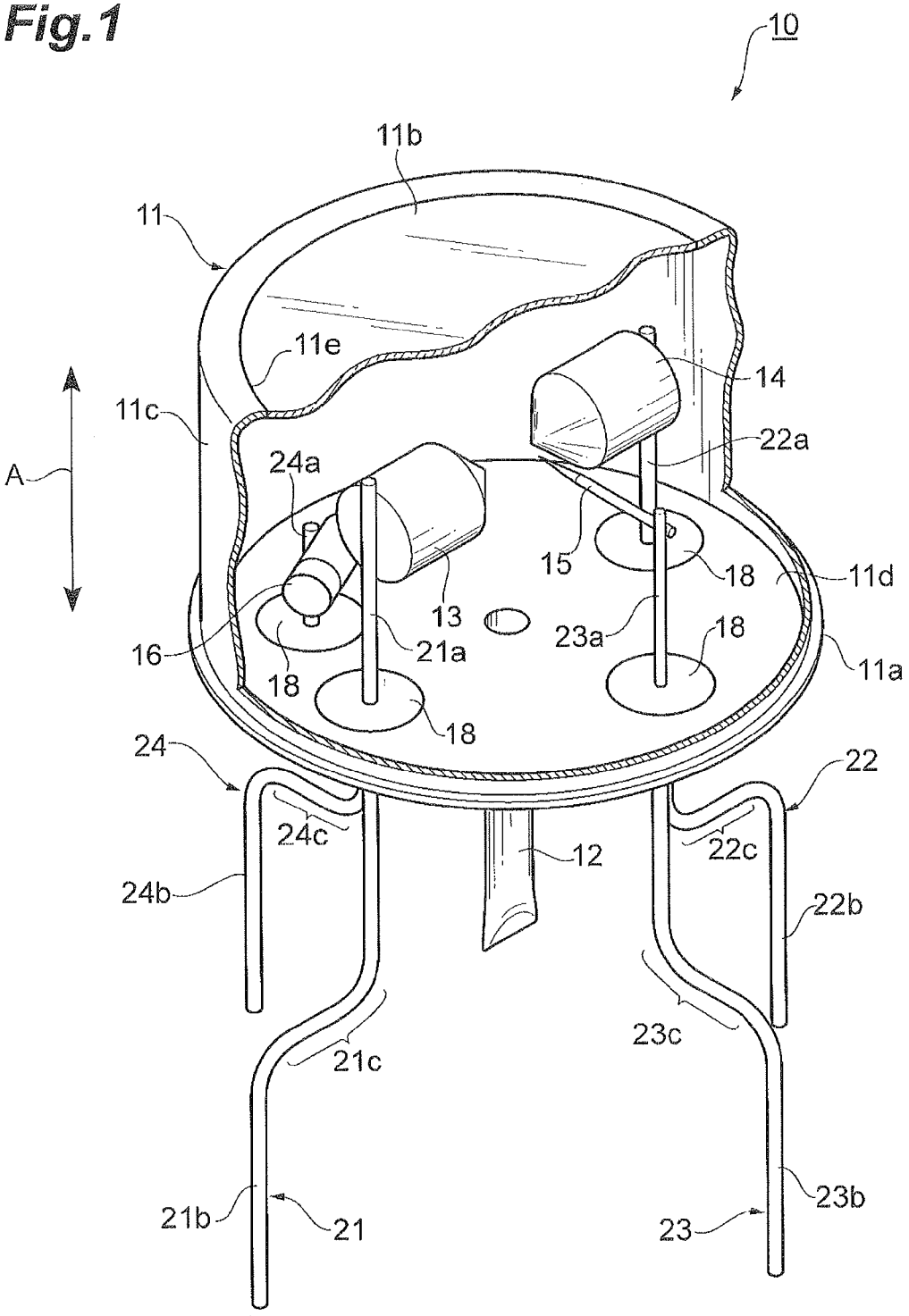
FIG. 1 is a partly-cutaway perspective view showing the appearance of a flash lamp included in a flash light source device according to one embodiment.

FIG. 1 is a partly-cutaway perspective view showing the appearance of a flash lamp 10 included in the flash light source device according to one embodiment of the present invention. The flash lamp 10 of the present embodiment, different from the flash lamps of the straight tube type described in Patent Documents 2 to 4, has a configuration wherein all lead pins 21 to 24 project from one end side of the lamp. Since in the straight tube type flash lamps, the cathode and anode are arranged as separated from each other at both ends of the straight tube, they are unfit for lighting at high frequencies. In contrast to it, the flash lamp 10 in the present embodiment is configured so that the cathode 13 and the anode 14 are arranged in proximity, whereby it is fit for lighting at high frequencies, e.g., 10 Hz or higher.

As shown in FIG. 1, the flash lamp 10 has a sealed container 11 in which a discharge gas (e.g., xenon gas) is enclosed. The sealed container 11 has a substantially cylindrical shape a central axis direction of which is a predetermined direction (arrow A in the drawing), and has a stem 11*a*, a light transmission window 11*b*, and a side tube portion 11*c*.

The stem 11*a* is a metal member of a circular plate shape and is disposed on one end face of the sealed container 11 in the predetermined direction A. The stem 11*a* has an inner surface 11*d* intersecting with the predetermined direction A. The light transmission window 11*b* is a glass member of a circular plate shape and is disposed on the other end face of the sealed container 11 in the predetermined direction A. Light generated in the flash lamp 10 is emitted along the predetermined direction A through the light transmission window 11*b*. The side tube portion 11*c* is a metal member of a cylindrical shape extending along the predetermined direction A. One end of the side tube portion 11*c* in the predetermined direction A is closed by the stem 11*a*. Furthermore, the other end of the side tube portion 11*c* in the predetermined direction A is provided with an opening 11*e* of a circular cross-sectional shape formed at a position opposite to the inner surface 11*d* of the stem 11*a*, and the opening 11*e* is closed by the light transmission window 11*b*.

The stem 11*a* is provided with a sealing tube 12 which is sealed after the xenon gas is charged into the sealed container 11. The sealing tube 12 projects from the one end face of the sealed container 11 in the predetermined direction A and its tip is crushed to implement sealing.

Arranged in the sealed container 11 are the cathode 13 and anode 14 for inducing arc discharge, a trigger electrode 15 for inducing pre-discharge prior to the arc discharge, and a sparker electrode 16 for stably inducing the arc discharge. The cathode 13 and the anode 14 are arranged in juxtaposition in a direction intersecting with the predetermined direction A. The cathode 13 and the anode 14 are fixed while being electrically connected to respective ends of the lead pins 21 and 22 penetrating the stem 11*a* through respective insulating members 18. The trigger electrode 15 is fixed to an end of the lead pin 23 penetrating the stem 11*a* through an insulating member 18. The sparker electrode 16 is fixed to an end of the lead pin 24 penetrating the stem 11*a* through an insulating member 18. In the present embodiment, there is only one trigger electrode provided, but the number of trigger electrodes is increased or decreased depending upon the distance between the cathode 13 and the anode 14.

The lead pin 21 is the first lead pin in the present embodiment. The lead pin 21 has its one end connected to the cathode 13 as described above, and the other end thereof is provided so as to project from the one end face of the sealed container 11 in the predetermined direction A. The lead pin 22 is the second lead pin in the present embodiment. The lead pin 22 has its one end connected to the anode 14 as described above, and the other end thereof is provided so as to project from the one end face of the sealed container 11 in the predetermined direction A. The lead pins 23, 24 are also provided similarly so as to project from the one end face of the sealed container 11 in the predetermined direction A.

The lead pins 21 to 24 in the present embodiment respectively include base end portions 21*a* to 24*a* extending along the predetermined direction A and fixed to the stem 11*a* of the sealed container 11, and distal end portions 21*b* to 24*b* extending along the predetermined direction A and fixed to a below-described wiring board. Furthermore, the lead pins 21 to 24 respectively include bend portions 21*c* to 24*c* each of which is bent into a direction away from the central axis of the sealed container 11 between the base end portion 21*a*-24*a* and the distal end portion 21*b*-24*b*. This makes the spaces between the distal end portions 21*b* to 24*b* of the respective lead pins 21 to 24 wider than the spaces between the base end portions 21*a* to 24*a* of the respective lead pins 21 to 24.

Figure 2:
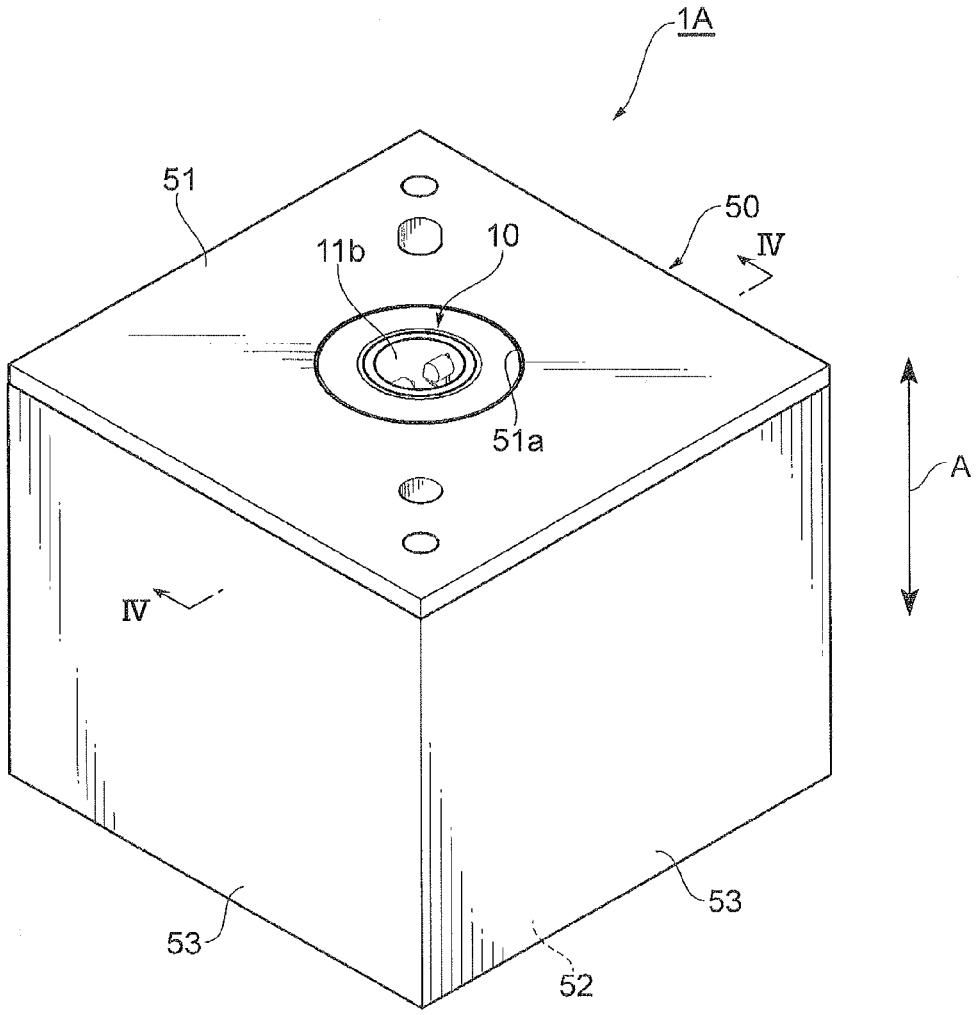
FIG. 2 is a perspective view showing the appearance of the flash light source device.
Figure 3:
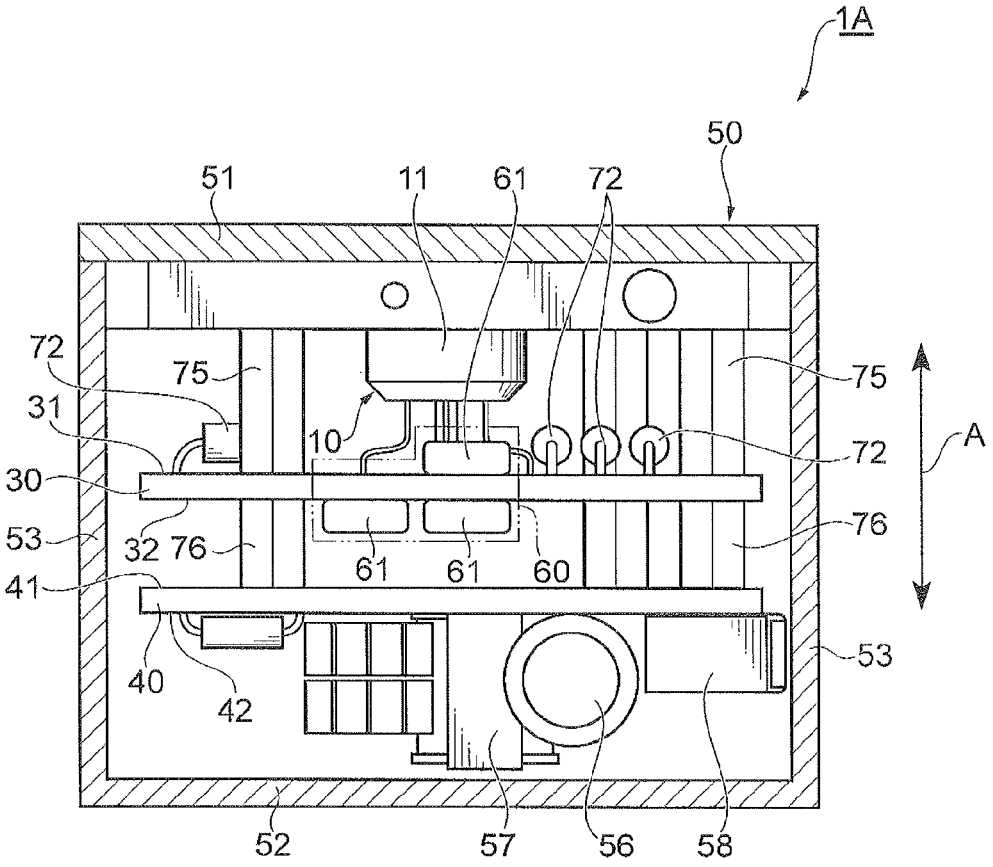
FIG. 3 is a partly-cutaway side view showing an internal configuration of the flash light source device.
Figure 4:
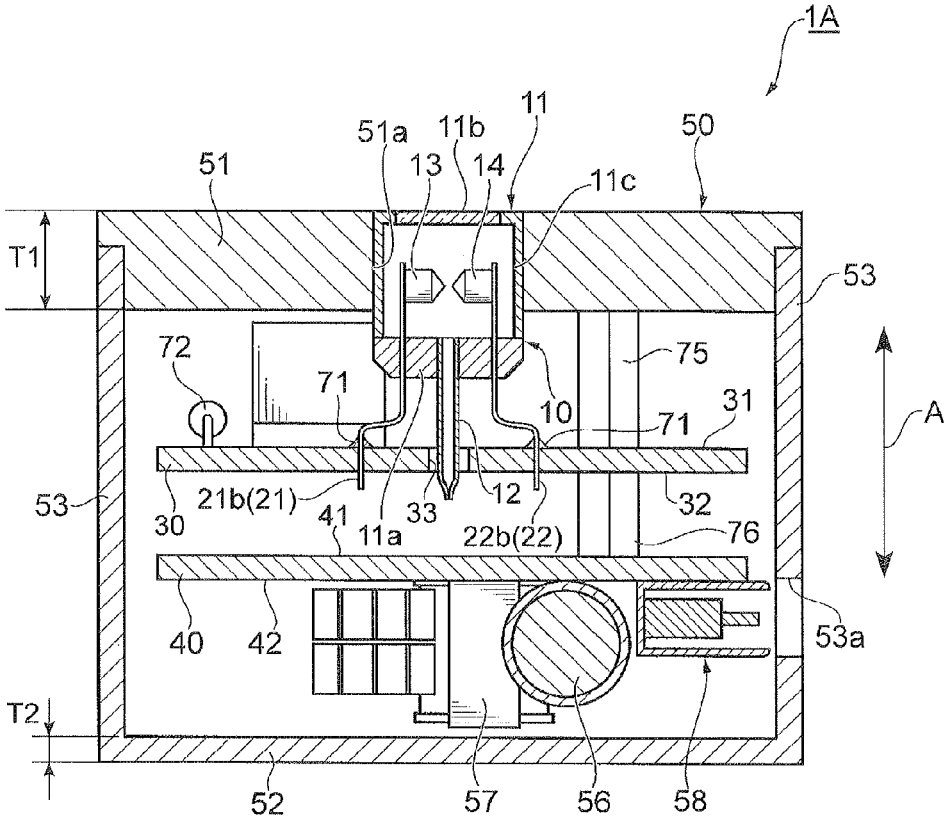
FIG. 4 is a side cross-sectional view of the flash light source device.

FIG. 2 is a perspective view showing the appearance of the flash light source device 1A according to the present embodiment. FIG. 3 is a partly-cutaway side view showing the internal configuration of the flash light source device 1A obtained by removing one side plate from the flash light source device 1A shown in FIG. 2. FIG. 4 is a side cross-sectional view along the line IV-IV of the flash light source device 1A shown in FIG. 2.

As shown in FIG. 2 to FIG. 4, the flash light source device 1A of the present embodiment has two wiring boards 30 and 40, and a housing 50. The wiring board 30 has a principal surface 31 and a back surface 32 intersecting with the predetermined direction A, and is fixed through spacers 75 to a heat radiator plate 51 so that the principal surface 31 is opposed to the heat radiator plate 51 described below. As shown in FIG. 4, the distal end portions 21*b* to 24*b* of the lead pins 21 to 24 of the flash lamp 10 (cf. FIG. 1) arranged opposite to the principal surface 31 are bonded with solder 71 so as to be fixed in an electrically conductive manner to this wiring board 30.

Various circuit elements for letting the flash lamp 10 emit light are mounted on the principal surface 31 and on the back surface 32 of the wiring board 30. One of these circuit elements is a power feeding unit 60 (cf. FIG. 3) to implement charge and discharge of an electric current to be supplied to the flash lamp 10. The power feeding unit 60 in the present embodiment has a plurality of (three in the drawing) chip capacitors 61 surface-mounted on the wiring board 30. These chip capacitors 61 are connected in parallel to each other and store the electric current to be supplied to the flash lamp 10.

The power feeding unit 60 may have a single chip capacitor 61, but it is preferred to use a plurality of chip capacitors 61, particularly, with a need for a large electric current, for the following reason: in the case where the power feeding unit 60 has the plurality of chip capacitors 61, a load per chip capacitor can be kept down and heat generated by the chip capacitors themselves can be reduced. A typical chip capacitor 61 is one which has the appearance of a substantially rectangular parallelepiped shape extending in a direction along the mount surfaces of the wiring board 30, and which has electrodes formed at two respective ends thereof in the foregoing extending direction. The chip capacitors 61 of this kind suitably applied are, for example, chip ceramic capacitors.

At least one chip capacitor 61 of the plurality of chip capacitors 61 is preferably surface-mounted on the back surface 32 of the wiring board 30. For example, in the present embodiment, of the three chip capacitors 61, two chip capacitors 61 are surface-mounted on the back surface 32 and the remaining one chip capacitor 61 is surface-mounted on the principal surface 31.

Various circuit elements other than the power feeding unit 60 are also mounted on the wiring board 30. For example, with reference to FIG. 3, a plurality of resistor elements 72 are mounted on the principal surface 31 of the wiring board 30.

The wiring board 30 has a circular hole 33 penetrating the wiring board 30 in its thickness direction. The hole 33 is formed in a portion opposed to the sealing tube 12, in the wiring board 30, and its diameter is sufficiently larger than the diameter of the sealing tube 12. This hole 33 functions to prevent contact between the wiring board 30 and the sealing tube 12 (particularly, the tip thereof sealed by being crushed). It is noted that the hole 33 may be replaced by a depressed portion made in the principal surface 31 of the wiring board 30 toward the back surface 32.

The wiring board 40 has a principal surface 41 and a back surface 42, and is fixed to the wiring board 30 through spacers 76 so that the principal surface 41 is opposed to the back surface 32 of the wiring board 30. Various circuit elements are mounted also on the wiring board 40. For example, with reference to FIG. 3, there are an electrolytic capacitor 56 for removal of power-supply noise, and a transformer 57 interposed between a primary circuit on the power supply side and a secondary circuit on the flash lamp 10 side, as mounted on the back surface 42 of the wiring board 40. Furthermore, a connector 58 for electrical connection to an external circuit outside the flash light source device 1A is mounted on the back surface 42.

The housing 50 has the appearance of a substantially rectangular parallelepiped shape, as shown in FIG. 2. The housing 50 has a heat radiator plate (top plate) 51, a bottom plate 52, and side plates 53. These all are made of metal. As shown in FIG. 3 and FIG. 4, the heat radiator plate 51 and the bottom plate 52 are collaterally arranged in the predetermined direction (arrow A), and are opposed to each other with the wiring boards 30 and 40 in between. The heat radiator plate 51 is arranged opposite to the principal surface 31 of the wiring board 30 and the wiring board 30 is fixed through the spacers 75 to the heat radiator plate 51 as described above. The bottom plate 52 is arranged opposite to the back surface 42 of the wiring board 40. A through hole 51*a* penetrating the heat radiator plate 51 along its thickness direction (i.e., along the predetermined direction A) is formed in the heat radiator plate 51, and the sealed container 11 of the flash lamp 10 is inserted in this through hole 51*a*. The metallic side tube portion 11*c* of the sealed container 11 is in contact with the likewise-metallic heat radiator plate 51, whereby these are thermally coupled.

Without having to be limited to the case where the metallic side tube portion 11*c* of the sealed container 11 and the likewise-metallic heat radiator plate 51 are in direct contact with each other, they may be thermally coupled with an intermediate member made of metal or a material with high thermal conductivity in between them. The outer surface of the light transmission window 11*b* of the flash lamp 10 is flush with the outer surface of the heat radiator plate 51. As shown in FIG. 4, the thickness T1 of the heat radiator plate 51 in the predetermined direction A is made larger than the thickness T2 of the bottom plate 52.

The side plates 53 extend along the predetermined direction A and connect the peripheral portion of the heat radiator plate 51 and the peripheral portion of the bottom plate 52 to each other. The shape of the side plates 53, when viewed from the predetermined direction A, is a substantially rectangular shape. In an example, it may be well configured as follows: the side plates 53 and the bottom plate 52 are integrally formed to constitute a bottomed container, and the heat radiator plate 51 is formed so that the heat radiator plate 51 is fitted in the opening of the bottomed container so as to close the opening. In this case, the side plates 53 are fixed to the heat radiator plate 51, for example, by screwing. An opening 53*a* for exposing the aforementioned connector 58 from the housing 50 is formed in part of the side plate 53.

Figure 5:
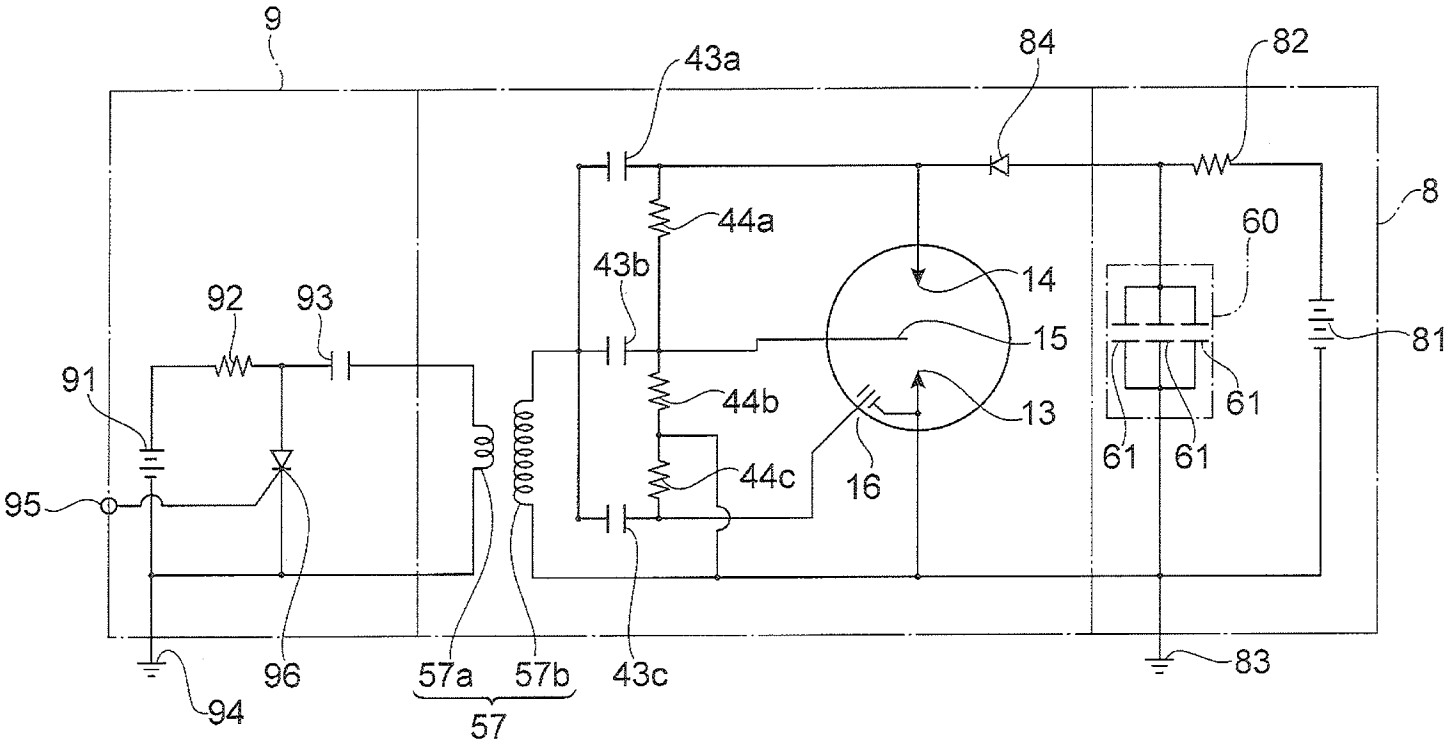
FIG. 5 is a circuit diagram showing an example of a circuit configuration to be mounted on a wiring board.

FIG. 5 is a circuit diagram showing an example of a circuit configuration to be mounted on the wiring boards 30 and 40. As shown in FIG. 5, this circuit has a main power supply unit 8 to apply a voltage between the anode 14 and the cathode 13, and a trigger power supply unit 9 to apply a trigger voltage for controlling light emission timing, to the trigger electrode 15.

The main power supply unit 8 has a main discharge power supply 81 for applying the voltage between the anode 14 and the cathode 13. One end of a resistor 82 is connected to the positive terminal of the main power supply unit 8. The negative terminal of the main discharge power supply 81 is connected to a reference potential line 83 set at the ground potential and is also connected to the cathode 13 of the flash lamp 10. The power feeding unit 60 is connected as a main capacitor for instantaneously supplying an electric current of large capacity to the flash lamp 10, between the other end of the resistor 82 and the reference potential line 83. The power feeding unit 60 has the plurality of (three in the drawing) chip capacitors 61 connected in parallel to each other, as described previously with FIG. 3. As described above, the power feeding unit 60 may be configured by a single chip capacitor 61. The other end of the resistor 82 and the positive terminal of the power feeding unit 60 are connected via a rectifying element 84 to the anode 14.

The trigger power supply unit 9 is provided with a trigger power supply 91 to generate the trigger voltage. The positive terminal of the trigger power supply 91 is connected via a resistor 92 and a trigger capacitor (assist capacitor) 93 to one end of a primary coil 57*a* of the transformer 57. The negative terminal of the trigger power supply 91 is connected to a reference potential line 94 set at the ground potential and is also connected to the other end of the primary coil 57*a* of the transformer 57. A thyristor 96 to function as a switch with a trigger signal fed from an input terminal 95 is connected between a node between the resistor 92 and the trigger capacitor 93, and the reference potential line 94.

One end of a secondary coil 57*b* of the transformer 57 is connected to each of one-end-side electrodes of respective capacitors 43*a* to 43*c*. The other-end-side electrode of the capacitor 43*a* is connected to the anode 14, the other-end-side electrode of the capacitor 43*b* is connected to the trigger electrode 15, and the other-end-side electrode of the capacitor 43*c* is connected to the sparker electrode 16. The anode 14 and the trigger electrode 15 are connected to each other via a resistor 44*a*, and the trigger electrode 15 and the sparker electrode 16 are connected to each other via resistors 44*b* and 44*c*. The other end of the secondary coil 57*b* of the transformer 57 is connected to the reference potential line 83 and to the cathode 13, and a node between the resistor 44*b* and the resistor 44*c* is also connected to the reference potential line 83 and to the cathode 13.

The operation of the flash light source device 1A of the present embodiment having the above configuration will be described. First, the main discharge power supply 81 applies the predetermined voltage between the anode 14 and the cathode 13 and charges the power feeding unit 60. On the other hand, the trigger power supply unit 9 is fed with the trigger signal through the terminal 95 to turn the thyristor 96 on, whereupon an electric charge stored in the trigger capacitor 93 is output. This results in applying a pulse voltage from 100 to 300 V to the primary coil 57*a* of the transformer 57. This pulse voltage is amplified in the transformer 57 and a pulse voltage from 5 to 7 kV is output from the secondary coil 57*b*. This pulse voltage is applied, to the anode 14, the trigger electrode 15, and the sparker electrode 16.

In the flash lamp 10, pre-discharge is first induced by the sparker electrode 16, pre-discharge is then induced between the cathode 13 or the anode 14 and the trigger electrode 15, and these establish a pre-discharge path. Immediately thereafter, main discharge is induced along the pre-discharge path between the cathode 13 and the anode 14, to cause arc emission. When the discharge occurs between the cathode 13 and the anode 14, an electric charge stored in the power feeding unit 60 is output together with the electric current by the main power supply 81.

The effects achieved by the flash light source device 1A of the present embodiment will be described. As described above, the conventional flash light source devices generally use the film capacitor as a capacitor for instantaneously supplying a large electric current to the flash lamp. However, the film capacitor is large in size and contributes to a hindrance to the size reduction of the flash light source device.

In contrast to it, the flash light source device 1A of the present embodiment is configured so that the power feeding unit 60 for instantaneously supplying the large electric current to the flash lamp 10 has one chip capacitor or a plurality of chip capacitors 61 surface-mounted on the wiring board 30. The chip capacitors are extremely smaller in size than the film capacitors. Therefore, it becomes feasible to achieve size reduction of the flash light source device IA and thus the flash light source device can be constructed, for example, in the size of half in terms of volume in comparison to the conventional flash light source devices.

Since there is no need for locating the large-size film capacitor beside the flash lamp, the shape of the housing 50 can be, for example, a square when viewed from the predetermined direction A of the light emission direction as in the present embodiment. For example, when the flash light source device 1A is installed, for example, with the side plate 53 being opposed to an installation surface, as long as the shape of the housing 50 is square when viewed from the light emission direction, the light emission position is unchanged even with a 90° change of the arrangement direction of the cathode 13 and the anode 14 relative to the installation surface, and thus the arrangement direction of the cathode 13 and the anode 14 with respect to an irradiation object can be optionally and readily set.

It is preferred that, as in the present embodiment, the flash light source device 1A be provided with the heat radiator plate 51 of metal thermally coupled to the sealed container 11, and the heat radiator plate 51 be arranged opposite to the wiring board 30. When the device is provided with such a heat radiator plate 51, it can efficiently dissipate heat generated from the flash lamp 10 and thermal influence is reduced on the circuit elements on the wiring board 30. Particularly, in the case where the chip capacitors 61 in the power feeding unit 60 are ceramic capacitors, they are weaker against heat than the conventional film capacitors, and thus the chip capacitors 61 can operate more suitably within an operating temperature range when the heat radiator plate 51 as described above is provided. When the power feeding unit 60 has the plurality of chip capacitors 61, the load per chip capacitor 61 is kept down and thus the heat generated by the chip capacitors 61 themselves can also be reduced.

As in the present embodiment, the side tube portion 11*c* of the sealed container 11 is preferably made of metal. Since this improves the thermal conductivity of the sealed container 11 to efficiently transfer the heat generated by light emission of the flash lamp 10 to the heat radiator plate 51, the aforementioned heat dissipation effect can be more enhanced. Furthermore, the heat radiator plate 51 preferably has the through hole 51*a* in which the sealed container 11 is inserted, whereby the transfer of heat is further efficiently implemented from the sealed container 11 to the heat radiator plate 51.

As in the present embodiment, the heat radiator plate 51 of the housing 50 is preferably thicker than the bottom plate 52. When the heat radiator plate 51 is made thicker in this manner, the heat capacity of the heat radiator plate 51 increases, so as to further enhance the foregoing heat dissipation effect.

It is preferred that, as in the present embodiment, at least one chip capacitor 61 be surface-mounted on the back surface 32 of the wiring board 30. This causes the wiring board 30 to block the heat radiating from the flash lamp 10 and from the heat radiator plate 51, whereby thermal influence is further reduced on the chip capacitor 61 mounted on the back surface 32.

In the case where the flash lamp 10 has the sealing tube 12, as shown in FIG. 4, it is preferred that the hole 33 (or the depressed portion) be formed in the portion opposed to the sealing tube 12, in the wiring board 30. When the sealing tube 12, together with the lead pins 21 to 24, projects from the end face of the sealed container 11, it can interfere with the wiring board 30 and thus the flash lamp 10 and the wiring board 30 have to be located with a sufficient space in between, which contributes to a hindrance to the size reduction of the flash light source device 1A. When the hole 33 (or the depressed portion) is formed in the portion opposed to the sealing tube 12, in the wiring board 30 as in the present embodiment, it becomes feasible to achieve further size reduction of the flash light source device 1A, while solving the problem as described above. Furthermore, since contact is prevented between the tip of the sealing tube 12 sealed by being crushed and the wiring board 30, it is feasible to prevent breakage of sealing due to stress on the tip. For this reason, the flash light source device 1A can also improve in stability.

Furthermore, as shown in FIG. 1, the spaces between the distal end portions 21*b* to 24*b* of the lead pins 21 to 24 (particularly, the lead pin 21 connected to the cathode 13 and the lead pin 22 connected to the anode 14) are preferably wider than the spaces between the base end portions 21*a* to 24*a*. Since this can widen the spaces between the lead pins 21 to 24 on the wiring board 30, it can suppress degradation of withstand voltage performance in conjunction with the size reduction of the flash light source device 1A. In addition, since stability is enhanced for attachment of the flash lamp 10 to the wiring board 30, anti-vibration performance can be improved.

It is preferred that the lead pins 21 to 24 further include the bend portions 21*c* to 24*c*, as shown in FIG. 1. Since this prevents excess bending stress from being imposed on the base end portions 21*a* to 24*a* of the lead pins 21 to 24 and the base end portions 21*a* to 24*a* can be arranged along the thickness direction of the stem 11*a*, it is feasible to widen the spaces between the distal end portions 21*b* to 24*b*, while suppressing influence on the sealing performance at the base end portions 21*a* to 24*a*, In the case where the flash light source device 1A has the main capacitor (power feeding unit 60) to supply the electric current for the main discharge and the trigger capacitor 93 to supply the electric current for assisting start of the main discharge, as shown in FIG. 5, at least the main capacitor is preferably constituted by the chip capacitor 61. When the main capacitor for the charge and discharge of the larger electric current is configured by the chip capacitor 61, the flash light source device 1A can be effectively constructed in a smaller size. In this case, however, the trigger capacitor 93 is better constituted by the chip capacitor as well, in addition to the main capacitor (power feeding unit 60). This can achieve further size reduction of the flash light source device 1A.

The flash light source device according to the present invention is not limited to the foregoing embodiment, but can be modified in many other ways. For example, in the above embodiment, the side tube portion 11*c* of the sealed container 11 of the flash lamp 10 is made of metal, but the side tube portion 11*c* may be made of another material, e.g., glass, and the shape thereof does not have to be limited to the substantially cylindrical shape, either, and may be a substantially polygonal tubular shape. Furthermore, the flash lamp 10 is a head-on type to extract light in a direction along the predetermined direction A, but it may be a side-on type to extract light in a direction intersecting with the predetermined direction A.

The cathode 13 and the anode 14 are arranged in juxtaposition in the direction intersecting with the predetermined direction A, but they may be arranged in juxtaposition in the direction along the predetermined direction A. Furthermore, the flash lamp 10 is bonded with solder 71 so as to be fixed in an electrically conductive manner directly to the wiring board 30, but it may be fixed in an electrically conductive manner to the wiring board 30 through a socket to fit with the lead pins 21 to 24. The lead pins 21 to 24 do not have to be limited to the configuration wherein the bend portions 21*c* to 24*c* make the spaces between the distal end portions 21*b* to 24*b* thereof wider than the spaces between the base end portions 21*a* to 24*a*, but they may extend linearly in directions away from the central axis of the sealed container 11 from the base end portions 21*a* to 24*a* toward the distal end portions 21*b* to 24*b*.

In the above embodiment, the chip ceramic capacitors are shown as examples of the chip capacitors 61, but various capacitors other than the ceramic capacitors may also be used as the chip capacitors in the present invention as long as they have the chip shape that can be surface-mounted on the wiring board.

The flash light source device according to the above embodiment is configured to comprise: the flash lamp including the sealed container having the substantially tubular shape with the central axis direction along the predetermined direction and having the discharge gas enclosed therein, the cathode and the anode arranged in juxtaposition in the sealed container to induce arc discharge, and the first and second lead pins projecting from one end face of the sealed container in the predetermined direction and respectively electrically connected to the cathode and to the anode; the wiring board which has the principal surface and the back surface intersecting with the predetermined direction and to which the first and second lead pins of the flash lamp arranged opposite to the principal surface are fixed in an electrically conductive manner; and the power feeding unit for implementing the charge and discharge of the electric current to be supplied to the flash lamp, wherein the power feeding unit includes one or a plurality of chip capacitors surface-mounted on the wiring board.

The flash light source device may have the configuration wherein the device further comprises the heat radiator plate of metal thermally coupled to the sealed container, and wherein the heat radiator plate is arranged opposite to the wiring board. When the device is provided with such a heat radiator plate, the heat generated from the flash lamp is efficiently dissipated, so as to enable reduction of the thermal influence on the circuit elements on the wiring board. Particularly, in the case where the chip capacitors of the power feeding unit are the ceramic capacitors, they are weaker against heat than the conventional film capacitors and thus, when the device is provided with the heat radiator plate as described above, the chip capacitors can operate better.

The flash light source device may have the configuration wherein the side tube portion along the predetermined direction of the sealed container is made of metal. This improves the thermal conductivity of the sealed container, whereby the heat generated by light emission in the flash lamp is efficiently transferred to the heat radiator plate, so as to further enhance the aforementioned heat dissipation effect.

Furthermore, the flash light source device may have the configuration wherein the heat radiator plate has the through hole in which the sealed container is inserted. This makes the transfer of heat implemented more efficiently from the sealed container to the heat radiator plate.

The flash light source device may have the configuration wherein the device comprises the housing including the heat radiator plate, the bottom plate opposed to the heat radiator plate with the wiring board in between, and the side plate connecting the peripheral portion of the heat radiator plate and the peripheral portion of the bottom plate to each other, and wherein the heat radiator plate is thicker than the bottom plate. When the heat radiator plate is made thicker in this manner, the heat capacity of the heat radiator plate increases, so as to further enhance the foregoing heat dissipation effect.

The flash light source device may have the configuration wherein at least one chip capacitor is surface-mounted on the back surface of the wiring board. This causes the wiring board to interrupt the heat dissipated from the flash lamp and the heat radiator plate, whereby the thermal influence on the chip capacitor can be further reduced.

The flash light source device may have the configuration wherein the flash lamp further includes the sealing tube projecting from the one end face of the sealed container in the predetermined direction, and wherein the depressed portion or the hole is formed in the portion opposed to the sealing tube, in the wiring board. If the sealing tube provided for hermetically sealing the sealed container of the flash lamp is arranged so as to project along with the lead pins from the end face of the sealed container, the flash lamp and the wiring board must be arranged with a sufficient space in between them, in order to avoid interference with the wiring board, which would contribute to a hindrance to the size reduction of the flash light source device. When the depressed portion or the hole is formed in the portion opposed to the sealing tube, in the wiring board as described above, the foregoing problem is solved, so as to enable further size reduction of the flash light source device.

The flash light source device may have the configuration wherein the first and second lead pins respectively include the base end portions fixed to the sealed container and the distal end portions fixed to the wiring board, and wherein the space between the distal end portion of the first lead pin and the distal end portion of the second lead pin is wider than the space between the base end portion of the first lead pin and the base end portion of the second lead pin. This can widen the space between the first lead pin and the second lead pin on the wiring board, which can suppress degradation of withstand voltage performance due to the size reduction of the flash light source device, The flash light source device may have the configuration wherein the first and second lead pins further respectively include the bend portions each of which is bent into the direction away from the central axis of the sealed container between the base end portion and the distal end portion. This can widen the space between the distal end portions, while suppressing influence on the sealing function at the base end portions of the first and second lead pins.

The flash light source device may be configured so that the device comprises the main capacitor for supplying the electric current for the main discharge, and the assist capacitor for supplying the electric current for assisting start of the main discharge, and so that at least the main capacitor is constituted by the chip capacitor of the power feeding unit. When the main capacitor for the charge and discharge of the larger electric current is constituted by the chip capacitor, the flash light source device can be effectively constructed in a smaller size.

The flash light source device may be configured so that both of the main capacitor and the assist capacitor are constituted by the chip capacitors. This allows the flash light source device to be constructed in a much smaller size.

INDUSTRIAL APPLICABILITY

The present invention is applicable as the flash light source device that can be constructed in a smaller size.

REFERENCE SIGNS LIST

1A—flash light source device, 8—main power supply unit, 9—trigger power supply unit, 10—flash lamp, 11—sealed container, 11*a*—stem, 11*b*—light transmission window, 11*c*—side tube portion, 12—sealing tube, 13—cathode, 14—anode, 15—trigger electrode, 16—sparker electrode, 18—insulating member, 21-24—lead pin, 21*a*-24*a* base end portion, 21*b*-24*b*—distal end portion, 21*c*-24*c*—bend portion, 30, 40—wiring board, 33—hole, 50—housing, 51—heat radiator plate, 52—bottom plate, 53—side plate, 56—electrolytic capacitor, 57—transformer, 58—connector, 60—power feeding unit, 61—chip capacitor, 71—solder, 72—resistor element, 75—spacer.

The invention claimed is:

1. A flash light source device comprising:

a flash lamp including a sealed container having a substantially tubular shape with a central axis direction along a predetermined direction and having a discharge gas enclosed therein, a cathode and an anode arranged in juxtaposition in the sealed container to induce arc discharge, and first and second lead pins projecting from one end face of the sealed container in the predetermined direction and electrically connected to the cathode and to the anode, respectively;

a wiring board having a principal surface and a back surface intersecting with the predetermined direction, and to which the first and second lead pins of the flash lamp arranged opposite to the principal surface are fixed in an electrically conductive manner;

a power feeding unit for charge and discharge of an electric current to be supplied to the flash lamp; and a heat radiator plate of metal thermally coupled to the sealed container and arranged opposite to the wiring board, wherein the power feeding unit includes one or a plurality of chip capacitors surface-mounted on the wiring board, the sealed container has a light transmission window disposed on the other end face of the sealed container, the heat radiator plate has a through hole in which the light transmission window side of the sealed container is inserted, and at least part of a side tube portion of the sealed container is surrounded by an inner surface of the through hole so that the sealed container is thermally coupled to the heat radiator plate, and the heat radiator plate is arranged separate from the wiring board via a space, and the one end face side of the sealed container is arranged in the space and arranged separate from the wiring board.

2. The flash light source device according to claim 1, wherein a region between the cathode and the anode in the sealed container is surrounded by the inner surface of the through hole.

3. The flash light source device according to claim 1, wherein the side tube portion along the predetermined direction of the sealed container is made of metal.

4. The flash light source device according to claim 1, comprising a housing including the heat radiator plate, a bottom plate opposed to the heat radiator plate with the wiring board in between, and a side plate connecting a peripheral portion of the heat radiator plate and a peripheral portion of the bottom plate to each other, wherein the heat radiator plate is thicker than the bottom plate.

5. The flash light source device according to claim 1, wherein at least one said chip capacitor is surface-mounted on the back surface of the wiring board.

6. The flash light source device according to claim 1, wherein the flash lamp further includes a sealing tube projecting from the one end face of the sealed container in the predetermined direction, and a depressed portion or a hole is formed in a portion opposed to the sealing tube, in the wiring board.

7. The flash light source device according to claim 1, wherein the first and second lead pins respectively include base end portions fixed to the sealed container and distal end portions fixed to the wiring board, and a space between the distal end portion of the first lead pin and the distal end portion of the second lead pin is wider than a space between the base end portion of the first lead pin and the base end portion of the second lead pin.

8. The flash light source device according to claim 7, wherein the first and second lead pins further respectively include bend portions each of which is bent into a direction away from a central axis of the sealed container between the base end portion and the distal end portion.

9. The flash light source device according to claim 1, comprising a main capacitor supplying an electric current for main discharge, and an assist capacitor supplying an electric current for assisting start of the main discharge, wherein at least the main capacitor is constituted by the chip capacitor of the power feeding unit.

10. The flash light source device according to claim 9, wherein both of the main capacitor and the assist capacitor are constituted by the chip capacitors.

11. The flash light source device according to claim 1, wherein the chip capacitor has an appearance of a substantially rectangular parallelepiped shape extending in a direction along the principal surface and the back surface of the wiring board, and has electrodes formed at two respective ends thereof in the extending direction.

12. A flash light source device comprising:

a flash lamp including a sealed container having a substantially tubular shape with a central axis direction along a predetermined direction and having a discharge gas enclosed therein, a cathode and an anode arranged in juxtaposition in the sealed container to induce arc discharge, and first and second lead pins projecting from one end face of the sealed container in the predetermined direction and electrically connected to the cathode and to the anode, respectively;

a wiring board having a principal surface and a back surface intersecting with the predetermined direction, and to which the first and second lead pins of the flash lamp arranged opposite to the principal surface are fixed in an electrically conductive manner;

a power feeding unit for charge and discharge of an electric current to be supplied to the flash lamp; and a housing having an appearance of a substantially rectangular parallelepiped shape, and including a top plate, a bottom plate opposed to the top plate with the wiring board in between, and a side plate connecting a peripheral portion of the top plate and a peripheral portion of the bottom plate to each other, wherein the power feeding unit includes one or a plurality of chip capacitors surface-mounted on the wiring board, the top plate, the bottom plate, and the side plate of the housing are all made of metal, and a shape of the housing is a square when viewed from the predetermined direction.

13. The flash light source device according to claim 12, wherein a light emission surface of the flash lamp is located at a center of the top plate.

14. The flash light source device according to claim 12, wherein a light emission surface of the flash lamp is flush with an outer surface of the top plate.

15. The flash light source device according to claim 12, wherein the top plate of the housing is a heat radiator plate of metal thermally coupled to the sealed container, and the heat radiator plate is arranged opposite to the wiring board.

16. The flash light source device according to claim 15, wherein a side tube portion along the predetermined direction of the sealed container is made of metal.

17. The flash light source device according to claim 15, wherein the heat radiator plate has a through hole in which the sealed container is inserted.

18. The flash light source device according to claim 15, wherein the heat radiator plate is thicker than the bottom plate.

19. The flash light source device according to claim 12, wherein at least one said chip capacitor is surface-mounted on the back surface of the wiring board.

20. The flash light source device according to claim 12, wherein the flash lamp further includes a sealing tube projecting from the one end face of the sealed container in the predetermined direction, and a depressed portion or a hole is formed in a portion opposed to the sealing tube, in the wiring board.

21. The flash light source device according to claim 12, wherein the first and second lead pins respectively include base end portions fixed to the sealed container and distal end portions fixed to the wiring board, and a space between the distal end portion of the first lead pin and the distal end portion of the second lead pin is wider than a space between the base end portion of the first lead pin and the base end portion of the second lead pin.

22. The flash light source device according to claim 21, wherein the first and second lead pins further respectively include bend portions each of which is bent into a direction away from a central axis of the sealed container between the base end portion and the distal end portion.

23. The flash light source device according to claim 12, comprising a main capacitor supplying an electric current for main discharge, and an assist capacitor supplying an electric current for assisting start of the main discharge, wherein at least the main capacitor is constituted by the chip capacitor of the power feeding unit.

24. The flash light source device according to claim 23, wherein both of the main capacitor and the assist capacitor are constituted by the chip capacitors.

25. The flash light source device according to claim 12, wherein the chip capacitor has an appearance of a substantially rectangular parallelepiped shape extending in a direction along the principal surface and the back surface of the wiring board, and has electrodes formed at two respective ends thereof in the extending direction.

* * * * *